US008434252B2

(12) United States Patent
Holmberg

(10) Patent No.: US 8,434,252 B2
(45) Date of Patent: May 7, 2013

(54) RECOIL ABSORBING STOCK

(76) Inventor: Gregory J. Holmberg, Dover, FL (US)

( * ) Notice: Subject to any disclaimer, the term of this patent is extended or adjusted under 35 U.S.C. 154(b) by 0 days.

(21) Appl. No.: 13/353,289

(22) Filed: Jan. 18, 2012

(65) Prior Publication Data

US 2012/0180353 A1 Jul. 19, 2012

Related U.S. Application Data

(60) Provisional application No. 61/433,943, filed on Jan. 18, 2011.

(51) Int. Cl.
*F41A 21/00* (2006.01)

(52) U.S. Cl.
USPC ..... 42/1.06; 42/71.01; 42/73; 42/74

(58) Field of Classification Search ..... 42/1.06, 42/71.01, 72, 73, 74, 75.01, 75.03
See application file for complete search history.

(56) References Cited

U.S. PATENT DOCUMENTS

| | | | | |
|---|---|---|---|---|
| 2,273,878 | A | 2/1942 | Magrum et al. | |
| 3,039,222 | A | 6/1962 | Hoge | |
| 3,176,424 | A | 4/1965 | Hoge | |
| 3,233,354 | A | 2/1966 | Ahearn | |
| 3,425,318 | A | 2/1969 | Whitehill | |
| 3,707,797 | A * | 1/1973 | Ruth | 42/74 |
| 4,644,930 | A | 2/1987 | Mainhardt | |
| 4,663,877 | A * | 5/1987 | Bragg | 42/74 |
| 4,769,937 | A * | 9/1988 | Gregory et al. | 42/74 |
| 5,031,348 | A | 7/1991 | Carey | |
| 5,159,148 | A | 10/1992 | Vinghog | |
| 5,367,812 | A | 11/1994 | Lautrec | |
| 5,392,553 | A * | 2/1995 | Carey | 42/73 |
| 5,410,833 | A * | 5/1995 | Paterson | 42/73 |
| 6,481,142 | B1 | 11/2002 | McCarthy | |
| 6,481,143 | B2 * | 11/2002 | McCarthy | 42/74 |
| 6,543,172 | B1 | 4/2003 | Armstrong | |
| 6,553,707 | B1 | 4/2003 | Tseng | |
| 6,668,478 | B2 * | 12/2003 | Bergstrom | 42/1.06 |
| 6,688,031 | B2 | 2/2004 | Steele | |
| 7,131,228 | B2 | 11/2006 | Hochstrate et al. | |
| 7,131,367 | B1 | 11/2006 | Boerschig et al. | |
| 7,162,822 | B1 | 1/2007 | Heayn et al. | |
| 7,478,495 | B1 * | 1/2009 | Alzamora et al. | 42/74 |
| 7,493,845 | B2 | 2/2009 | Mantas | |
| 7,681,351 | B2 | 3/2010 | Bucholtz | |
| 7,748,154 | B2 * | 7/2010 | Moretti | 42/75.03 |
| 7,762,018 | B1 | 7/2010 | Fitzpatrick et al. | |
| 7,793,453 | B1 | 9/2010 | Sewell, Jr. et al. | |
| 7,805,873 | B2 | 10/2010 | Bentley | |

(Continued)

*Primary Examiner* — Michael Carone
*Assistant Examiner* — Derrick Morgan
(74) *Attorney, Agent, or Firm* — Aaron Paul McGushion

(57) ABSTRACT

A recoil absorption system for a long gun is provided that includes at least one fluid-filled piston shock attached between the body of the rifle and the stock to provide a damped connection between the two. When large caliber rounds are fired, the shocks are permitted to compress, so that the buffer tube is correspondingly permitted to travel rearward within the buffer tube bore of the stock. The stocks detent pin is normally captured within a slot on the buffer tube, such that the long gun recoil causes the buffer tube slot to move relative to the pin, the pin restricts the buffer tube movement and compression of the shocks to the length of the slot. In this way, the recoil energy of large caliber rounds is effectively absorbed, providing a more comfortable and accurate shooting experience.

8 Claims, 4 Drawing Sheets

U.S. PATENT DOCUMENTS

| | | | | |
|---|---|---|---|---|
| 7,823,313 | B2 * | 11/2010 | Faifer | 42/74 |
| 7,877,917 | B2 | 2/2011 | Cinciu | |
| 8,176,668 | B2 * | 5/2012 | Simms et al. | 42/1.06 |
| 2002/0053156 | A1 * | 5/2002 | McCarthy | 42/74 |
| 2006/0096146 | A1 * | 5/2006 | Fitzpatrick et al. | 42/71.01 |
| 2006/0096148 | A1 * | 5/2006 | Beretta | 42/74 |
| 2006/0168869 | A1 | 8/2006 | Daul et al. | |
| 2006/0254111 | A1 * | 11/2006 | Giauque et al. | 42/72 |
| 2006/0254112 | A1 | 11/2006 | Snoderly | |
| 2007/0214697 | A1 | 9/2007 | Ochoa | |
| 2008/0028662 | A1 | 2/2008 | Abraham et al. | |
| 2008/0110074 | A1 * | 5/2008 | Bucholtz et al. | 42/1.06 |
| 2009/0300963 | A1 | 12/2009 | Hines | |
| 2009/0313875 | A1 | 12/2009 | Hines | |
| 2010/0071246 | A1 | 3/2010 | Vesligai | |
| 2010/0229444 | A1 | 9/2010 | Faifer | |
| 2010/0242328 | A1 | 9/2010 | Faifer | |
| 2010/0242333 | A1 | 9/2010 | Kincel | |
| 2010/0251587 | A1 | 10/2010 | Kincel | |
| 2011/0258899 | A1 * | 10/2011 | Fitzpatrick et al. | 42/71.01 |
| 2011/0283584 | A1 * | 11/2011 | Walters | 42/73 |
| 2012/0023802 | A1 * | 2/2012 | Vesligai | 42/71.01 |

* cited by examiner

RECOIL ABSORBING STOCK

RELATED APPLICATION DATA

This application claims the priority date of provisional application No. 61/433,943 filed on Jan. 18, 2011.

BACKGROUND

AR15 rifles are currently one of the most popular rifles in the US. The fully automatic M16 version of this rifle was developed for, and adopted by the US military in 1963 and has been our primary battle rifle since. Because of the M16's military success and long service, a substantial industry has grown to produce and customize this weapon platform in numerous ways. In addition to its longevity, the rifle's modularity further lends itself to customization, since aftermarket parts & accessories easily bolt on.

Prior to 1967, the US used a heavier, 11.5 lb., M14 rifle that used the much more powerful 7.62 NATO cartridge; now the typical M16 weighs 7.8 lbs. In searching for a new weapons platform, the army sought a smaller, lighter rifle that recoiled less and used lighter ammunition, allowing troops to carry more ammo and gear. Thus, the M16 was downsized to use the smaller 5.56 mm NATO round, satisfying the army's desire for a more petite, lighter recoiling rifle that used lighter ammunition.

The AR15 platform is simple to accessorize and change calibers. The small 5.56 mm cartridge has served the US military well, but civilians and government agencies, have sought to fit larger cartridges into the AR15/M16. These large cartridges produce uncomfortable recoil that makes the small, light rifle painful to shoot. The most popular large calibers are the 0.50 Beowulf, 0.450 Bushmaster, and 0.458 SOCO M. The larger calibers have significant recoil; and as a result, transfer that energy to the shooter's shoulder. The US Coast Guard has adopted one of the larger calibers to enable them to disable boats by shooting and breaking their engine blocks with the AR15.

The larger and heavier rounds produce significantly more recoil energy than the standard round, up to ten times more. Although others have placed shock absorption systems within the small area available in the rifle stock, the current systems do not adequately absorb recoil energy due in part to insufficient compression. What is needed is recoil system that can absorb large amounts of recoil energy through a large compression, while maintaining the compact design requirements of the M16/AR15 rifles or similar long guns.

Standard AR15 collapsible stocks are designed to telescope (slide forward and back) on the buffer tube to adjust the length of pull of the rifle. The length of pull of the rifle is the length from the trigger to the end of the stock which rests against the shooter's shoulder. The length of pull is adjusted to accommodate large to small-framed people, and to adjust to the thickness of clothing layers or body armor donned. The standard stock may be incrementally adjusted and locked in place with a standard spring-biased detent pin that engages one of the detent holes in a line of detent holes to prevent forward and back movement of the stock. To adjust the stock, the detent pin may be disengaged from a detent hole through actuation of the connected latch.

The buffer tube is a required part of the AR15/A16 rifle. Since the buffer tube houses the buffer spring and the buffer, there is insufficient space within the buffer tube to install a shock absorption means. Manufacturers have tried to place a shock absorption system internally within the stock, behind the buffer tube. However, due to the limited space and short length behind the buffer tube, the shocks installed have insufficient stroke length over which larger caliber round recoil may be absorbed. Once the current shocks are at full compression during large recoil, the unabsorbed energy is then transferred to the shooter. Basically, the shock absorbers are limited in compression due to the limited space near and behind the buffer tube, making the large caliber rounds uncomfortable to fire.

SUMMARY

A recoil absorption system for a long gun is provided, with a buffer tube insert configured to fit within the detent slot of the buffer tube to cover the detent holes. Further, a stock is provided with a buffer tube bore configured to receive the buffer tube. The stock is configured to slide along the buffer tube axis, and a detent pin is biased to extend transversely into the buffer tube bore and biased into the detent slot when the buffer tube is inserted into the buffer tube bore. At least one shock absorber is included, with a first end secured to the stock and a second end connected with the receiver, either directly or indirectly. The shock absorber biases the stock away from the receiver when under compression and provides recoil absorption through compression of the shock absorber. The buffer tube insert prevents the detent pin from engaging the detent hole. Further, the buffer tube insert is positioned within the detent slot to provide a bounded area through which the detent pin is restricted to travel as the stock axially slides along the buffer tube axis, where the travel of the detent pin limits the resulting travel of the stock relative to the buffer tube.

The bounded area provided by the buffer tube insert within the detent slot is divided into at least two sub-bounded areas which are smaller than the bounded area. When the detent pin is positioned within a first sub-bounded area it is permitted to slide only along the first sub-bounded area; and when the detent pin is positioned within a second sub-bounded area it is permitted to slide only along the second sub-bounded area, where the sub-bounded areas are divided by protrusions extending from the buffer tube insert.

The stock may further include at least one shock absorber bore configured to receive the first end of the shock absorber, the second end of the shock absorber is connected with the receiver through an end plate, where the first end and the second end may be one of the cylinder or the rod of the shock absorber. Preferably, two shock absorbers provide recoil absorption, with the shock absorbers positioned externally to the buffer tube and alongside the buffer tube, such that compression of the shock absorbers is parallel to the buffer tube axis.

An alternate recoil absorption system for a long gun includes a stock with a buffer tube bore configured to receive the buffer tube and a shock absorber bore, where the stock configured to slide along the buffer tube axis. Additionally, at least one shock absorber is included with a first end fitted within the shock absorber bore and a second end connected to the body of the rifle. The shock absorber acts to bias the stock away from the body when under compression and provides recoil absorption through compression of the shock absorber.

Yet another alternate recoil absorption system for a long gun includes a buffer tube that is substantially cylindrical and has a cylindrical axis. A slot is formed on the buffer tube outer surface, with the slot arranged parallel to the cylindrical axis. A stock is provided with a buffer tube bore configured to receive the buffer tube. The stock is configured to axially slide along the cylindrical axis of the buffer tube. A pin extends transversely into the buffer tube bore and is biased into the slot when the buffer tube is inserted within the buffer tube bore. A gas shock is additionally provided with a first end connected with the stock and a second end connected with body. The gas shock biases the stock away from the body when under compression and provides recoil absorption through compression of the gas shock. The slot provides a bounded area through which the pin is restricted to travel as the stock axially slides over the buffer tube, where the travel of the pin limits the resulting travel of the stock relative to the buffer tube. When two gas shocks are used, the compression of each is preferably equal.

Figure 1:
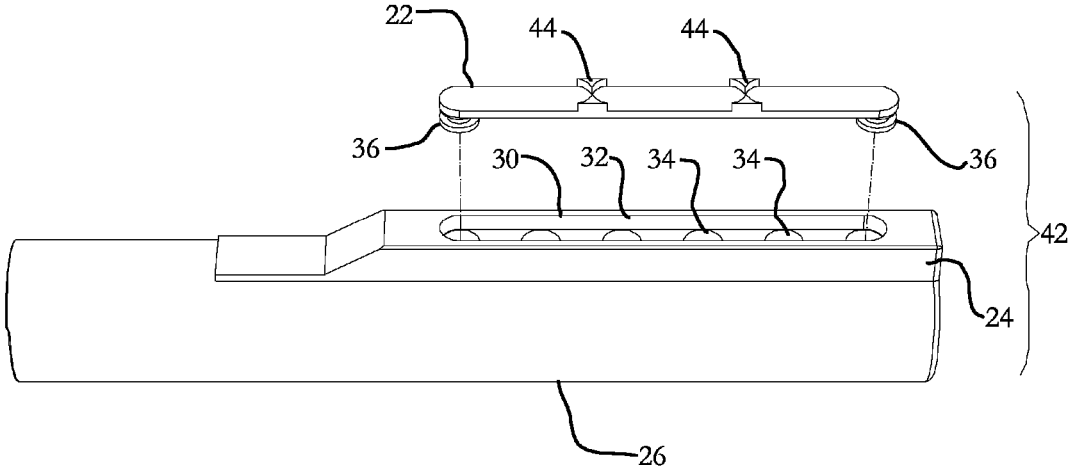
FIG. 1 is an exploded perspective view of the buffer tube assembly of the recoil absorption system.

LISTING OF REFERENCE NUMERALS OF FIRST-PREFERRED EMBODIMENT recoil absorption system 20
buffer tube insert 22
key 24
buffer tube 26
buffer tube axis 28
detent slot 30
slot wall 32
detent hole 34
locator pin 36
bounded area 38
sub-bounded area (or slotted area) 40*a*, 40*b*, 40*c*
buffer tube assembly 42
protrusion 44
stock 46
buffer tube bore 48
keyway 50
shock absorber bore 52
shock cylinder 54
shock rod 56
retrofit end plate 58
end plate 60
lower receiver 62
castle nut 64
rod bore 66
flange 68*a*, 68*b*
latch 70
detent pin 72
threaded end 74
shock absorber 76
rod end 78
rod end holder 80
clamping bore 82
clamping screw 84
gap 86

DESCRIPTION OF THE PREFERRED EMBODIMENTS

Turning first to FIG. 1, the buffer tube assembly (42) is shown in an exploded view, with the buffer tube insert (22) above and aligned with the detent slot (30) formed within a buffer tube (26). The spring and buffer (not shown) would be located within the hollow interior of the buffer tube (26) when attached to a long gun, such as an AR15 or M16. The buffer tube (26) shown in the present example embodiment is a standard buffer tube, with a key (24) that engages a keyway (50) within the stock (46) (shown in FIG. 3). Once engaged, the key (24) prevents rotation of the stock (46) relative to the buffer tube (26), yet allows incremental adjustment along the buffer tube axis (28). On the top side of the key (24) a detent slot or groove (30) is machined, with a plurality of detent holes (34) located on the bottom of the detent slot (30), and a slot wall (32) defining the perimeter or boundary of the slot (32).

The buffer tube insert (22) is shown in the present embodiment as elongated and substantially flat along much of the surface. On the upper surface, arced protrusions (44) extend from the upper surface. On the opposite or lower surface, locator pins (36) extend downward and are configured to be located within the detent holes (34) to secure the buffer tube insert (22) within the detent slot (30). An annular groove may be circumferentially machined on each of the locator pins (36) to retain an O-ring (not shown) within the annular groove. With the O-ring installed, the locator pins (36) will fit snuggly within their respective detent holes (34) to prevent the buffer tube insert (22) from slipping out of the detent slot (30). The buffer tube insert (22) may be machined from metal or other appropriate material, or molded from a plastic material with sufficient toughness. Further, the buffer tube insert (22) can be manufactured without the protrusions (44) on the upper surface, so that the entire upper surface would be flat.

Figure 2:
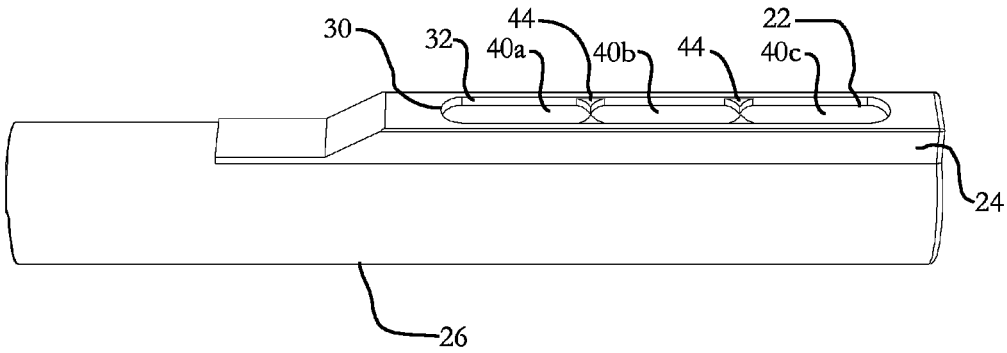
FIG. 2 is a perspective view of the buffer tube assembly of the recoil absorption system assembled.

FIG. 2 shows the buffer tube assembly (42), fully assembled and ready to be mated with the remainder of the recoil absorption system (20). The buffer tube insert (22) is shown fully inserted within the detent groove (30) so that all of the detent holes (34) are covered. However, the buffer tube insert (22) could be made shorter than the detent groove (30) so that only some of the detent holes (34) are covered. Once inserted within the detent slot (30), the buffer tube insert (22) creates three sub-bounded or slotted areas (40*a*, 40*b*, and 40*c*). It can be seen that the thickness of much of the buffer tube insert (22) is dimensionally thinner than the depth of the detent slot (30). In this way, when the buffer tube insert (22) is fitted within the detent slot (30), the detent slot wall (32) is still partially exposed, thus forming the walls or boundaries of the slotted areas (40*a*, 40*b*, and 40*c*). The protrusions (44) form the boundaries between adjacent slotted areas, separating slotted area 40*a* from 40*b* and separating slotted area 40*b* from 40*c*. It is contemplated that more or less than three slotted areas may be created by varying the protrusion (44) from zero to n, where n is the maximum desired or practicable number of protrusions, and n+1 would be the number of slotted areas created from a given number of protrusions n.

In existing systems, the buffer tube insert (22) is not be present, and the detent holes (34) within the detent slot (30) would be exposed. When a standard stock is installed over the standard buffer tube, a detent pin within the standard stock engages just one of the detent holes, the particular detent hole engaged depends on the shooter-adjusted length of pull. In this standard setup, the detent pin would not be permitted to freely slide within the detent slot, as the detent pin is biased to engage or pop into one of the detent holes as the stock slides over the buffer tube. In this way, the standard setup does not permit the stock to travel relative to the buffer tube once the detent pin has located or locked within a detent hole.

The present recoil absorption system (20) can retrofit a standard buffer tube (26) so that the stock (46) can axially slide forward and back (towards or way from the muzzle of the rifle) on the buffer tube (26) over a recoil absorption displacement, and not be locked into a static position as a result of the detent pin (72) locating within a detent hole (34). Furthermore, a custom buffer tube (not shown) can be manufactured where the top surface of the key is milled with the slotted areas (40*a*, 40*b*, and 40*c*), and no detent holes are provided. Thus, with a custom buffer tube, a separate buffer tube insert (22) is not required, as the desired slotted areas are already present.

Figure 4:
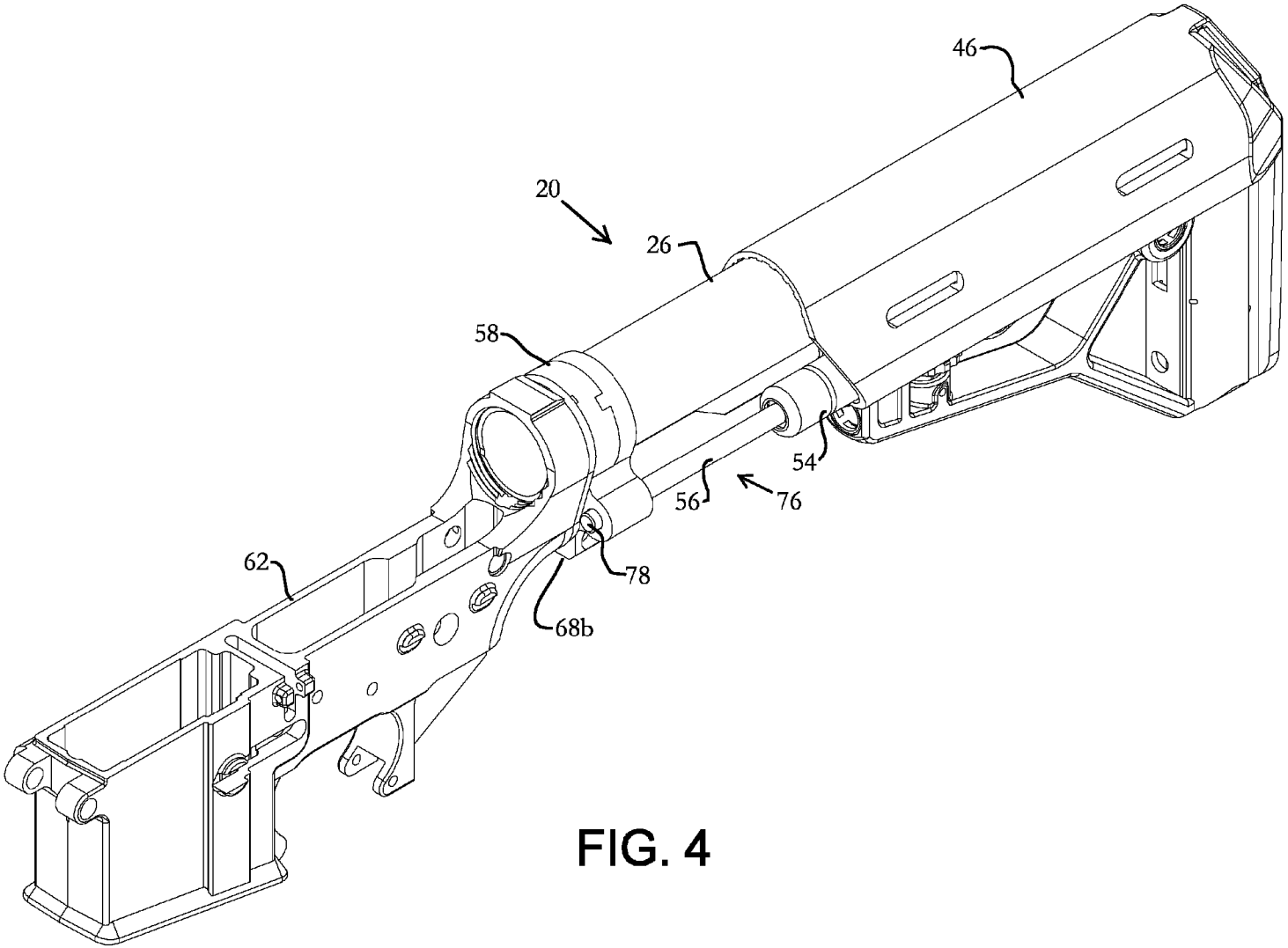
FIG. 4 is a perspective view of the recoil absorption system assembled.
Figure 5:
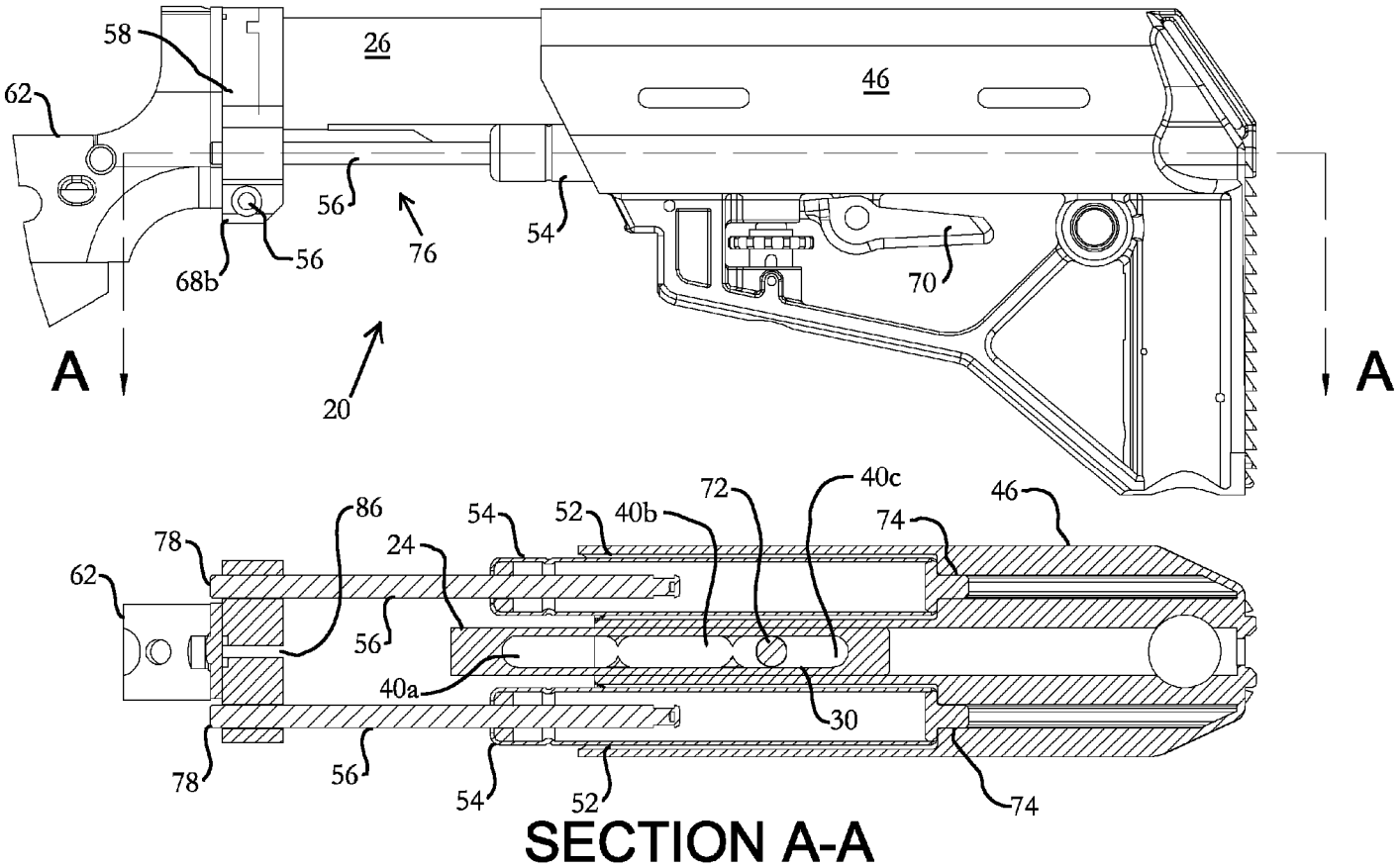
FIG. 5 is a side view of the recoil absorption system and a top section view taken at section A-A.

Looking now at FIG. 5, and in particular Section A-A, the key (24) of the buffer tube (26) can be seen in section, with the buffer tube insert (22) seated within the detent slot (30). The buffer tube (26) is inserted within the buffer tube bore (48) of the present stock (46), shown more clearly in FIGS. 3-4. Two shock absorbers (76) are shown in the present embodiment, the shock cylinder (54) is inserted into the stock (46), each held within a respective shock absorber bore (52). The shock absorbers (54) may be secured to the stock (46) by any appropriate means, in this example a threaded end (74) of the shock absorber (76) engages a corresponding thread at the bottom of the shock absorber bore (52). Although not required, substantial majority of the cylinder (54) for each shock absorber (76) is held within the respective shock absorber bore (52). This arrangement maintains a smooth external stock surface to prevent snagging and additionally may provide lateral support for the shock absorbers (76).

The rod (56) portion of the shock absorber (76) is connected to the body of the rifle, either directly to some portion of the body, such as the receiver (62), or through an intervening part connected to the body. In this example embodiment, the rods (56) are connected to the receiver (62) through the retrofit end plate (58). The ends of the rods (56) are inserted through the rod end holders (80), and are held there by various appropriate means, such as a retaining ring or a threaded engagement. Essentially, the body of the rifle and all connected parts, including the receiver (62) and the buffer tube (26), are permitted to move rearward in recoil upon firing the rifle, while the stock (46) moves rearward to a much lesser degree due to the rearward movement of the rifle body being substantially absorbed by compression of the shock absorbers (76). In recoil, the retrofit end plate (58) is pushed rearward with the body of the rifle, towards the shooter's shoulder. The retrofit end plate (58) then pushes the rods (56) of the shock absorbers (76) rearward, forcing the rods (56) further into the cylinders (54), where a damping fluid, gas or liquid, resists compression and thus absorbs recoil energy. In this way, the shooter is affected by recoil to a much lesser degree, permitting the repeated and accurate firing of large caliber rounds.

Still referring to FIG. 5, the retaining pin latch (70) is engaged within the detent slot (30), so that the retaining pin (72) extends transversely into the buffer tube bore (48) and is captured within one of the slotted areas (40*a*, 40*b*, or 40*c*). Note the detent holes (34) are still covered such that the detent pin (72) is not permitted to locate within the holes. In this case, the detent pin (72) is located and captured within slotted area (40*c*). The detent pin (72) is permitted to travel forward and back within slotted area (40*c*), but is not permitted to exit slotted area (40*c*) unless the latch (70) is manually actuated to pull the detent pin (72) out of slotted area (40*c*). When the latch (70) is actuated, the detent pin (72) can be relocated to one of the other slotted areas (40*a* or 40*b*). The length of pull for an individual shooter determines which slotted area (40*a*, 40*b*, or 40*c*) the detent pin (72) will be placed within. For example, slotted area (40*c*) would be chosen for a shorter length of pull, while slotted area (40*a*) would be chosen for a longer length of pull. Normally, because the stock (46) is biased rearward or away from the receiver (62) by the pre-compression of the shocks (76), the detent pin (72) would be located within the slotted area (40*c*) at its rearmost point. When the rifle is fired, the recoil pushes the buffer tube (26) further into the buffer tube bore (48) which is of sufficient depth to prevent the buffer tube (26) from impacting the bottom of the bore. Because the buffer tube (26) is displaced relative to the stock (46) and the slotted area (40*c*) is similarly displaced, the detent pin (72) travels from the rearmost portion of the slotted area (40*c*) towards the forward-most area of the slotted area (40*c*). Under pre-compression, the shocks (76) are partially compressed or loaded so that the stock (46) does not feel loose on the buffer tube (26). In this way, the stock (46) of the present embodiment feels solidly attached to the remainder of the rifle, and feels much like a standard stock at all times except when undergoing recoil. This is important, since an experienced shooter has become accustomed to a particular rifle feel and operation, which is not adversely affected by installation of the present system (20). Essentially, the shock absorbers (76) form a damped connection between the body of the rifle and the stock (46) that can be sufficiently stiff to resist compression, unless a substantial force is applied.

Each of the slotted areas (40*a*, 40*b*, and 40*c*) are configured to retain the detent pin (72) and permit limited forward and rearward travel of the detent pin (72), that travel corresponding to the length of each slotted area (40*a*, 40*b*, and 40*c*), which may or may not be of equal lengths. Because slotted area (40*c*) limits the travel of the detent pin (72) and the detent pin (72) is connected to the stock (46), the movement of the stock (46) relative to the body of the rifle is similarly limited, so that the compression length of the shock absorbers (76) substantially corresponds directly with the length of slotted area (40*c*). The length of the slotted areas can be varied depending on the caliber of the rifle. For a large caliber rifle, the recoil is significant and the slotted area should be correspondingly longer, so that the shock absorbers (76) are permitted to compress to a greater degree to absorb much of the recoil. A smaller caliber rifle would require a shorter slotted area, since the recoil is small and less compression is required to absorb the recoil.

Figure 3:
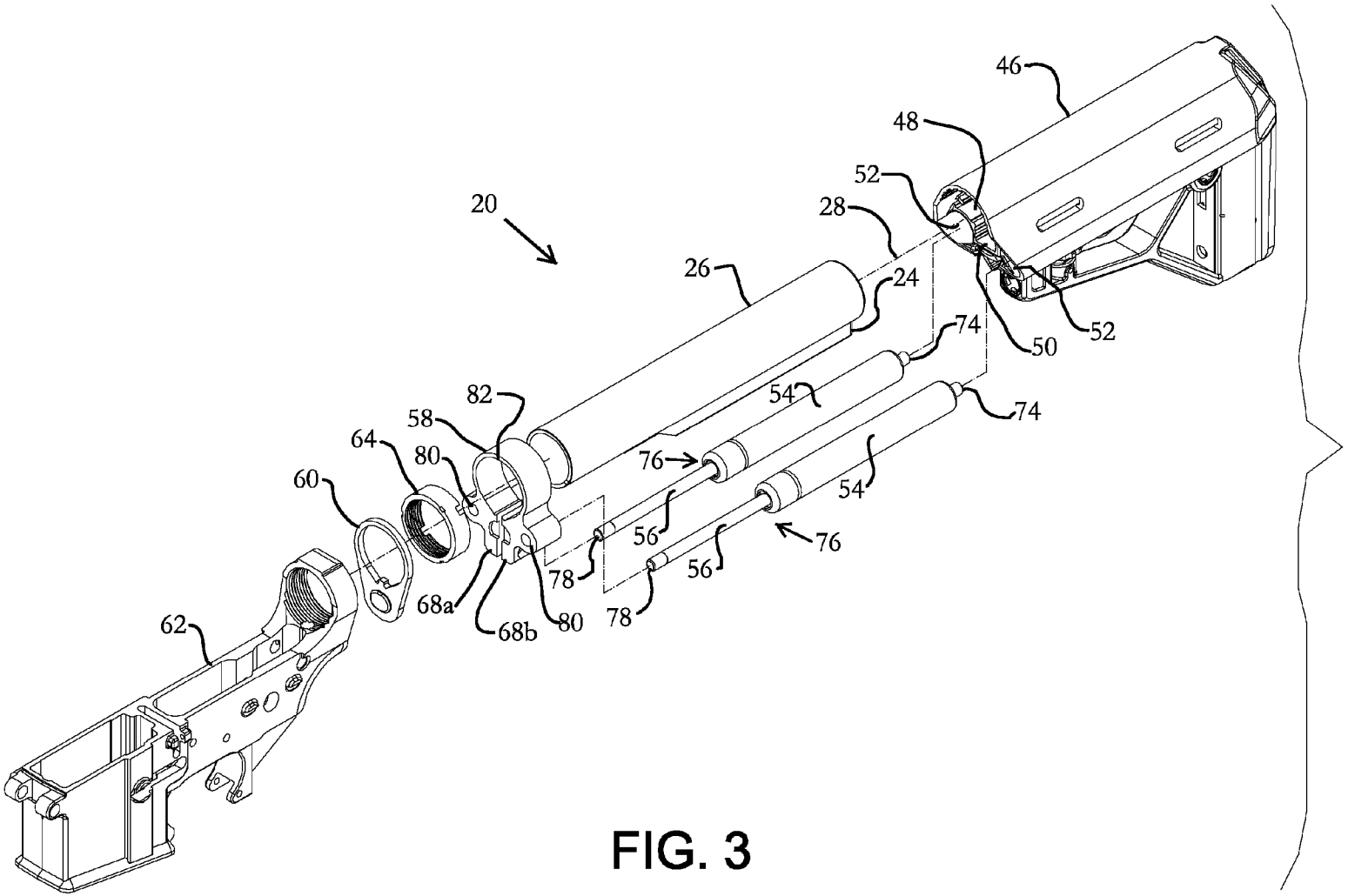
FIG. 3 is an exploded perspective view of the recoil absorption system.

Now referring to FIG. 3, the rifle receiver (62) and the present recoil absorption system (20) are shown in an exploded view to more clearly illustrate how the various parts fit together. The retrofit end plate (58) is designed to receive the buffer tube (26) within the clamping bore (82). The retrofit end plate (58) acts much like a clamp-on shaft collar, where the gap (86) permits the retrofit end plate (58) to loosely slide over the buffer tube (26). Once in position, the retrofit end plate (58) can be clamped down on the buffer tube (26) by tightening clamping screw (84) to bring together flanges (68*a* and 68*b*), where the gap (86) is reduced by the tightening of the screw, thus producing a clamping force about the buffer tube (26). The end plate (60) could be customized to include rod end holders (80) similar to the retrofit end plate (58), if the retrofit end plate (58) is eliminated. The retrofit end plate (58) compatibly engages the standard castle nut (64). The design of the retrofit end plate (58) permits it to be installed over the buffer tube (26) without removing the buffer tube (26) from the receiver (62) by sliding the retrofit end plate (58) onto the buffer tube (26) from the rear. This results in a substantial labor savings, due to the difficulties removing and reinstalling the buffer tube (26).

The present recoil absorption system (20) advantageously positions the shock absorbers externally to and alongside the buffer tube (26). The shock absorbers (76) are positioned alongside the buffer tube (26) and extend from the stock (46)

to the retrofit end plate (58) connected with the receiver (62). This unique arrangement permits the use of standard gas shocks, readily available in various industries (automotive, marine, and the like) and inexpensive to purchase. Because standard, full-sized shocks are utilized, three inches or more axial travel is permitted during recoil. The spring rate of the shocks may be varied by installing an adjustable shock or by exchanging the shock so that the system can be tuned to the shooter's preference. Although gas shocks are used to illustrate the present embodiment, any appropriate shock absorber may be utilized, so long as the compression length is sufficient to substantially absorb recoil.

Furthermore, since many shooters prefer the AR15-style stock, many have retrofitted non-AR15 long guns, such as shotguns or grenade launchers, to receive an AR15 stock. This is achieved by retrofitting the long gun with an empty or dummy buffer tube that can receive the AR15 stock. Thus, long guns retrofitted to be compatible with the AR15 stock can be adapted to receive the present recoil absorption system (20).

What is claimed is:

1. A recoil absorption system for a long gun having a receiver and a buffer tube with a buffer tube axis, a detent slot, and at least one detent hole located at a slot bottom of the detent slot, comprising:

a buffer tube insert configured to fit within the detent slot of the buffer tube to cover at least one detent hole;

a stock with a buffer tube bore configured to receive there within the buffer tube, the stock configured to slide along the buffer tube axis, and a detent pin extending transversely into the buffer tube bore and biased into the detent slot when the buffer tube is inserted into the buffer tube bore; and a shock absorber with a first end secured to the stock and a second end connected with a receiver, the shock absorber biasing the stock away from a receiver when under compression and providing recoil absorption through compression of the shock absorber;

wherein the buffer tube insert prevents the detent pin from engaging the detent hole, the buffer tube insert positioned within the detent slot providing a bounded area through which the detent pin is restricted to travel as the stock axially slides along the buffer tube axis, the travel of the detent pin limiting the resulting travel of the stock relative to the buffer tube wherein the bounded area provided by the buffer tube insert within the detent slot is divided into at least two sub-bounded areas which are smaller than the bounded area, when the detent pin is positioned within a first sub-bounded area it is permitted to slide only along the first sub-bounded area and when the detent pin is positioned within a second sub-bounded area it is permitted to slide only along the second sub-bounded area.

2. The recoil absorption system of claim 1 wherein the buffer tube insert is divided into the sub-bounded areas by protrusions extending from a top surface of the buffer tube insert.

3. The recoil absorption system of claim 1 wherein the stock further comprises a shock absorber bore configured to receive the first end of the shock absorber.

4. The recoil absorption system of claim 3 wherein the first end of the shock absorber is a cylinder and the second end is a rod, the shock absorber bore sized to receive a substantial portion of the cylinder.

5. The recoil absorption system of claim 4 wherein the cylinder includes an end thread that threadably engages a bottom of the shock absorber bore.

6. The recoil absorption system of claim 1 wherein the stock further comprises a shock absorber bore configured to receive the first end of the shock absorber, the second end of the shock absorber is connected with a receiver through an end plate.

7. The recoil absorption system of claim 6 wherein the first end of the shock absorber is a cylinder and the second end is a rod, shock absorber bore configured to receive the cylinder.

8. The recoil absorption system of claim 1 wherein two shock absorbers provide recoil absorption, the shock absorbers being positioned externally to the buffer tube and alongside the buffer tube, such that compression of the shock absorbers is parallel to the buffer tube axis.

* * * * *